US006045355A

United States Patent [19]

Chapman et al.

[11] Patent Number: 6,045,355

[45] Date of Patent: Apr. 4, 2000

[54] GAS CATALYTIC HEATERS WITH IMPROVED TEMPERATURE DISTRIBUTION

[75] Inventors: Michael J. Chapman, Portsmouth, R.I.; Thomas Etter, Meriden, Conn.

[73] Assignee: New England Catalytic Technologies, Inc., Portsmouth, R.I.

[21] Appl. No.: 09/059,055

[22] Filed: Apr. 11, 1998

Related U.S. Application Data

[60] Provisional application No. 60/043,636, Apr. 14, 1997.

[51] Int. Cl.[7] ..... F23D 14/14; F23D 14/18

[52] U.S. Cl. ..... 431/329; 431/326; 431/328

[58] Field of Search ..... 431/346, 326, 431/328, 329, 7

[56] References Cited

U.S. PATENT DOCUMENTS

| | | | |
|---|---|---|---|
| 3,024,836 | 3/1962 | Bello | 158/114 |
| 3,029,802 | 4/1962 | Webster | 126/93 |
| 3,057,400 | 10/1962 | Wagner | 431/329 |
| 3,073,379 | 1/1963 | Martin | 158/114 |
| 3,087,041 | 4/1963 | Vonk | 219/34 |
| 3,245,459 | 4/1966 | Keith | 158/99 |
| 3,784,353 | 1/1974 | Chapurin | 431/329 |

*Primary Examiner*—Carl Price
*Attorney, Agent, or Firm*—John R. Doherty

[57] ABSTRACT

A gas catalytic heater having an improved temperature distribution is disclosed which includes a body having an open end in which is disposed a porous catalytically active layer containing a catalyst such as platinum metal. A sealed plenum chamber is disposed below the catalytically active layer and has a gas-permeable wall portion facing toward the active layer and a gas inlet orifice for introducing a fuel gas into the chamber. The gas-permeable wall portion may comprise a perforated metal plate having a plurality of tiny apertures the total open area of which is significantly less than that provided by perforated plates used in catalytic heaters of the prior art.

12 Claims, 2 Drawing Sheets

GAS CATALYTIC HEATERS WITH IMPROVED TEMPERATURE DISTRIBUTION

This application claims benefit of Provisional Appln. No. 60/043,636 filed Apr. 14, 1997.

BACKGROUND OF THE INVENTION

1. Field of the Invention

The present invention relates to gas catalytic heaters in general and more particularly to a novel and improved system for uniformly dispersing a combustible gas or fuel within a catalytic heater.

2. Description of the Prior Art

In any catalytic heater, heat is produced when a gaseous fuel is brought into contact with a catalyst in the presence of air containing a normal level of oxygen. Typically, the fuels are natural gas, propane and butane, for example.

Generally, the combustible gas or fuel is fed through the bottom of the catalytic heater and is dispersed at atmospheric pressure into contact with a porous active layer. This layer contains a catalyst which may be platinum, for example. Oxygen from the atmosphere enters the porous catalytic layer and reacts with the gaseous fuel, promoted by the catalyst. This reaction releases the BTU content in the fuel in the form of radiant energy.

Catalytic heaters are therefore used as a source for infrared heat. The chemical reaction that occurs during the oxidation reduction process produces temperatures within the catalyst of from about 500 to 1000 degrees Fahrenheit (F.). The by-products of the reaction include carbon dioxide and water vapor. The temperature at the surface of the catalytic heater is dependent upon the rate at which the fuel gas is introduced to the catalyst. The surface of the heater is typically rectangular or circular and ranges from about one square foot to about 10 square feet. The volume of gas delivered to the catalytic surface may range from about 2 to 6 cubic feet of gas per hour per square foot.

The catalytic heaters that are commercially available today display a reasonably even or uniform distribution of temperature at the maximum rated input of 6 cubic feet of gas per hour per square foot. This will produce a reaction temperature on the heater surface of from about 750 to about 800 degrees Fahrenheit (F.). However, when operating at the lower flow rates, that is, about 2 cubic feet of gas per hour per square foot, the temperature distribution across the heater surface will vary from about 200 to about 800 degrees Fahrenheit (F.). This poses many problems particularly when the heaters are used for heating flat areas. The catalytic heaters develop hot and cold spots across the heating surface and produce an uneven heating profile to the object being heated. As a consequence, process control is very poor and efficiency is reduced.

Another disadvantage of commercially available catalytic heaters is that some of the combustible gas or fuel is left unreacted by the catalyst and escapes through the heater into the atmosphere. This phenomenon is referred to as "methane slippage" and is expressed as a percentage of the input BTU/hour. Tests have shown that commercial catalytic heaters exhibit methane slip rates of up to as high as 25 percent. Typical operating levels are about 15 percent of the input BTU/hour rate.

It is therefore an important object of the invention to provide a gas catalytic heater having an improved temperature distribution over the working surface or face of the heater.

Another more specific object of the invention is to provide a gas catalytic heater in which the combustible gas or fuel is distributed more evenly or uniformly to the porous catalytically active layer of the heater.

Still another object of the invention is to provide a gas catalytic heater in which the slippage of fuel gas passed the porous catalytically active layer is significantly reduced.

SUMMARY OF THE INVENTION

The present invention is directed to a gas catalytic heater characterized by a significantly improved temperature distribution over the surface of the working element of the heater. This improvement is made possible by the provision within the catalytic heater of a sealed plenum chamber into which the combustible gas or fuel is introduced.

The gas catalytic heater of the invention includes a body having an open end in which the working element is disposed. The working element may be a gas permeable catalytically active layer, that is, a porous layer containing a catalyst such as platinum metal. The sealed plenum chamber is disposed below the catalytically active layer and has a gas-permeable wall portion facing toward the active layer. The plenum chamber also has an inlet orifice for introducing the combustible gas or fuel under pressure into the plenum chamber.

According to the invention, the gas-permeable wall portion of the plenum chamber is so constructed as to have a permeability such that at a given flow rate of the combustible gas or fuel through the gas inlet, the gas flows continuously through the wall portion under substantially the same pressure as the internal pressure within the chamber. After passing through the gas-permeable wall portion, the gas flows into contact with the catalytically active porous layer and is uniformly distributed over its entire surface. Upon reacting with oxygen from the atmosphere at the catalyst site, the working element radiates infrared heat at substantially the same temperature over its entire working surface. There are essentially no "cold spots" at the surface of the working element even at very low gas flow rates through the heater.

In a preferred embodiment of the invention, the gas-permeable wall portion of the sealed plenum chamber comprises a perforated metal plate having a plurality of tiny holes or apertures therein which are substantially equally spaced apart from one another. The total open area provided by the tiny holes or aperture is significantly less than that provided by the perforated plates used in prior catalytic heaters. These heaters, of course, did not employ a sealed plenum chamber.

The perforated plate used in the catalytic heater of the invention is preferably placed within the bottom of the heater body in spaced apart relation from its bottom wall and is sealed around its outer peripheral edges to form a sealed plenum chamber according to the invention.

In another preferred embodiment of the invention, at least one layer of a porous heat insulating material is interposed between the gas-permeable wall portion of the sealed plenum chamber and the porous catalytically active layer. The porous insulating layer serves to prevent heat loss from occurring beneath the working element and also aids in distributing the gas or fuel evenly prior to reaching the catalyst.

An important feature of the invention that is used in this preferred embodiment is the provision of a porous baffle member interposed between the gas-permeable wall portion of the sealed plenum chamber and the heat insulating layer.

The insulating layer is typically made from a fibrous material the individual fibers of which upon contacting the perforated plate can easily block, plug and seal off the tiny holes or apertures, thereby reducing the effectiveness of the sealed plenum chamber.

The porous baffle member according to the invention is positioned on top of the perforated plate and keeps the fibers from entering and blocking the tiny holes or apertures. The baffle member also aids in a uniformly distributing the gas through the heat insulating layer after leaving the plenum chamber.

BRIEF DESCRIPTION OF THE DRAWINGS

The invention will now be described in greater detail with particular reference to the preferred embodiments thereof as illustrated in the accompanying drawings and in which.

DESCRIPTION OF THE PREFERRED EMBODIMENTS

Figure 1:
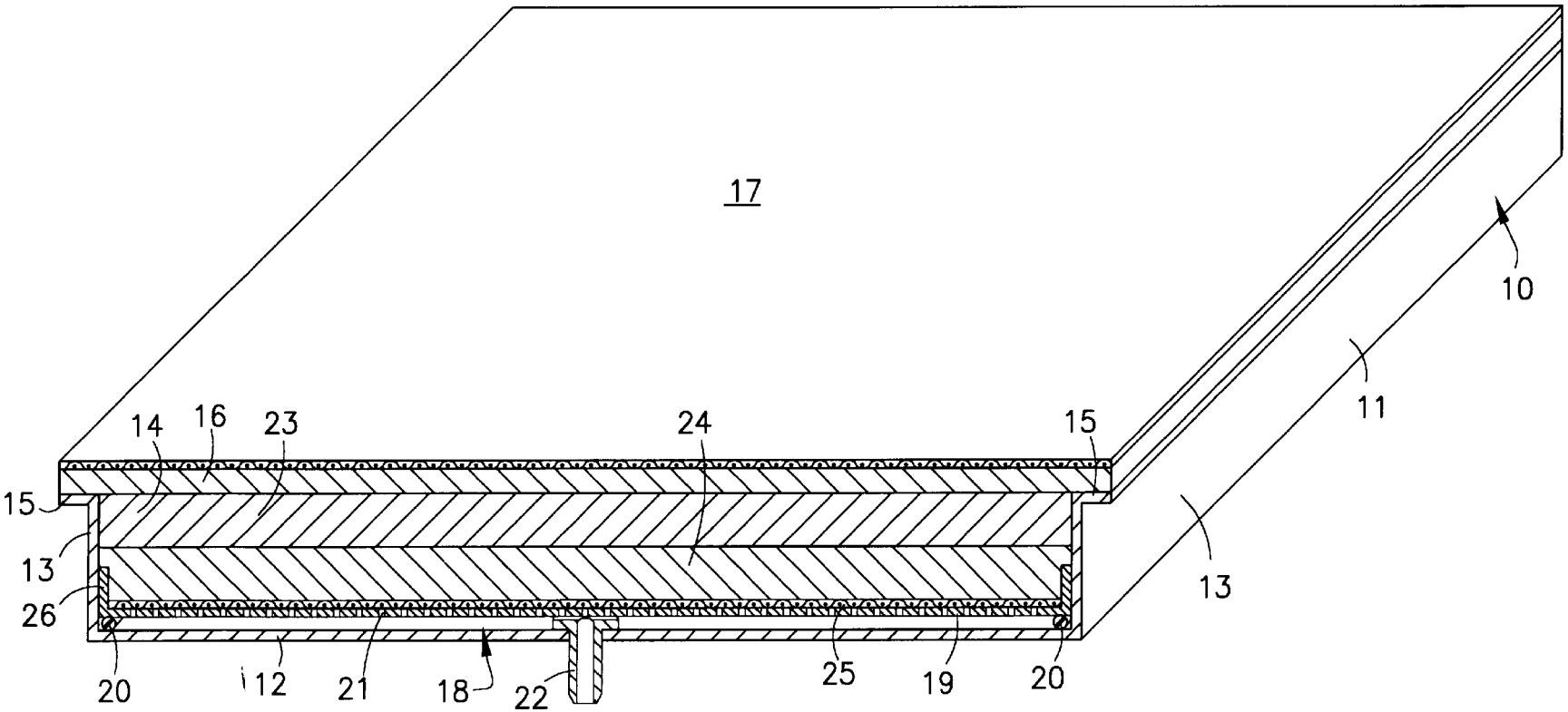
FIG. 1 is a perspective view, partly in section, of a gas catalytic heater according to the invention.
Figure 2:
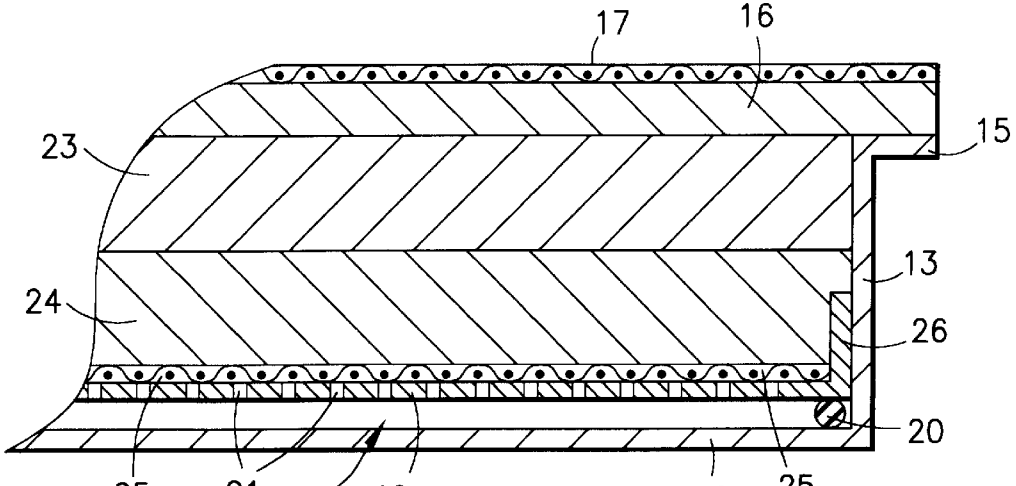
FIG. 2 is an enlarged sectional view of a portion of the gas catalytic heater shown in FIG. 1.

Referring now to the drawing, a gas catalytic heater embodying the invention is shown in FIGS. 1 and 2. The catalytic heater includes a body 10 in the form of a shallow, rectangular shaped metal pan 11 having a flat bottom wall 12, upstanding side walls 13 and an upper open end 14. The open end 14 of the pan 11 is formed with a peripheral flange portion 15 which supports a thin, porous, catalytically active layer 16. This catalytically active layer 16 is made from a fibrous, ceramic material, such as silica or alumina, for example, and is impregnated with an oxidation catalyst such as platinum, palladium or the oxides of chromium, cobalt or copper, for example. An open wire mesh or screen 17 rests on top of the porous catalytic layer 16 and allows for easy access of air and oxygen to the surface of the catalytic layer 16 from the surrounding atmosphere.

According to the invention, there is provided within the bottom of the catalytic heater a plenum chamber as shown at 18. The plenum chamber 18 is formed by mounting a perforated metal plate 19 in spaced apart relation above the bottom wall 12 of the metal pan 11. The perforated plate 19 rests on a resilient or adhesive bead 20 which is interposed between its outer peripheral edges and the bottom wall 12. The bead 20 serves to separate the plate 19 from the bottom wall 12 and to seal off the plenum chamber 18.

Figure 3:
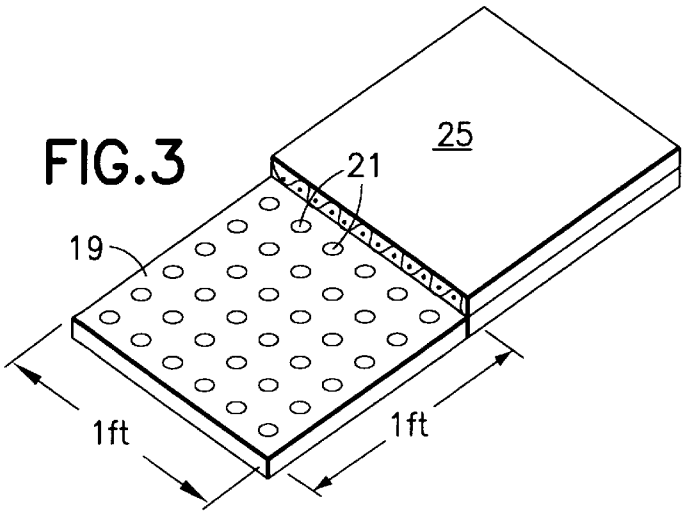
FIG. 3 is a perspective view of the perforated plate and porous baffle number used in the gas catalytic heater shown in FIGS. 1 and 2.

The perforated metal plate 19 contains a plurality of tiny holes or apertures 21 which communicate directly with the interior of the sealed plenum chamber 18. The holes or apertures 21 are substantially evenly spaced apart from one another within the plate 19 as best shown in FIGS. 2 and 3. The size and more particularly the open area provided by the tiny holes or apertures 21 is an important factor to be considered in the practice of the invention as shall be described in greater detail hereinafter.

As shown in FIG. 1, the plenum chamber 18 is relatively shallow in height but extends across the entire bottom of the catalytic heater providing a relatively large space or volume for containing the combustible gas or fuel prior to distribution to the catalytically active layer 16. The gas or fuel is fed to the sealed plenum chamber 18 via a small gas orifice 22 mounted within the bottom wall 12.

Disposed between the porous catalytic active layer 16 and the sealed plenum chamber 18 are two porous fibrous layers 23, 24 of heat insulating material, such as silica fibers, for example. The heat insulating layers 23, 24 thermally isolate the catalytic layer 16 from the bottom of the heater and also aid in distributing the gas evenly as it emerges from the perforated plate 19 prior to reaching the catalyst.

In order to prevent the fibers within the heat insulating layers 23, 24 from reaching and blocking the tiny holes or apertures 21 in the perforated plate 19, a baffle member 25 is disposed between the plate and the adjacent fibrous insulating layer 24. The baffle member 25 may be composed of metal, fiberglass, ceramic or an engineered plastic and can be cast or woven from these materials. The baffle can also be a non-woven material composed of randomly dispersed fibers or other similar structure. In the embodiment of the catalytic heater illustrated, the baffle number 25 is a woven metal mesh or screen.

The main purpose of the baffle number 25 is to prevent the combustible gas or fuel from being obstructed as it leaves the plenum chamber 18 and enters the insulating layers 23, 24. The baffle member also serves to more evenly distributed the gas or fuel as it emerges from the tiny holes or apertures 21.

Figure 4:
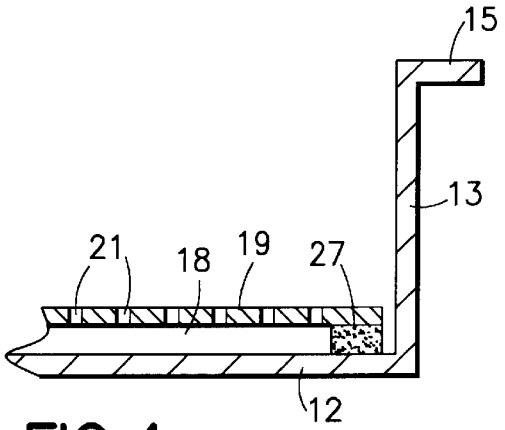
FIG. 4 is a view similar to FIG. 2 showing a different embodiment of the invention.

As shown in the FIGS. 1 and 2 of the drawing, the perforated metal plate 19 may also be formed with an upstanding rim portion 26 which fits snugly against the side walls 13 of the metal pan 11. This rim portion 26 aids in sealing off the plenum chamber 18 and also serves to secure the baffle member 25 within the bottom of the catalytic heater. FIG. 4 shows a different embodiment wherein the rim portion 26 is eliminated and the plenum chamber 18 is sealed off by a rectangular strip 27 of an adhesive type sealant.

Figure 5:
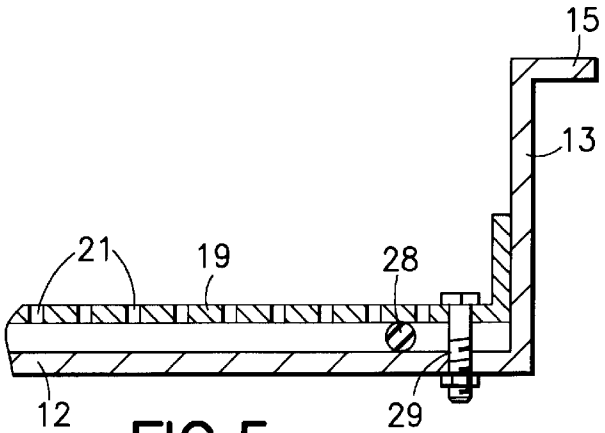
FIG. 5 is a similar view of a gas catalytic heater showing still another embodiment of the invention.

As noted herein above, the sealing bead 20 shown in FIGS. 1 and 2 may also be composed of a resilient material, such as rubber, for example. Such an embodiment is illustrated in FIG. 5 wherein a resilient sealing bead 28 is provided and is compressed into sealing relation between the perforated plate 19 and bottom wall 12 by a bold and nut 29. The plate 19 in this embodiment also includes the peripheral rim 26 as described above.

Typically, in catalytic heaters that are commercially available today, there is no sealed plenum. A perforated plate is used that covers a gas dispersion tube within the bottom of the heater. This plate is loosely placed, but not sealed, into the heater and supports the insulation layers, electric resistance heaters used to start the catalytic heater and finally the catalyst layer. The entire depth of the heater (approximately two inches) is employed for distributing the gas. The volume changes of gas within this apace are in the range of about 18 per hour for low fire rates and 36 per hour for high fire rates. In comparison, the sealed plenum chamber used in the catalytic heater of the invention is capable of between about 200 volume changes per hour at 3 cubic feet of gas flow per square foot per hour (low fire) and 800 volume changes at 6 cubic feet of gas flow per square foot per hour (high rate). By dramatically increasing the number of hourly volume changes, the catalytic heater of the invention is far more responsive to volume changes, providing rapid stabilization when changing from one flow rate to another. This is highly desirable, if not necessary, when adjusting the heaters to obtain the correct level of heat output for a given heating process.

The perforated plate used in prior art catalytic heaters typically has an "open area" of about 50 percent (%). In essence, this means that for every square foot of plate, there are 72 square inches of open area, and 72 square inches of closed area.

In the catalytic heater of the invention, the large open area perforated plate of the prior art has been replaced with a perforated plate, which not only serves to form a sealed plenum chamber as described, but in addition provides an open area of between about 0.009 and 0.06 percent (%) of the total area of the plate, with an average open area of about 0.03 percent (%), for example. The perforated plate in the present heater is sealed to the bottom of the heater pan, and replaces the gas distribution tubes presently used in commercial heaters. In terms of numbers, the 0.03% average open area provided by the present perforated plate is equal to about 0.0432 square inches of open area per square foot as compared to the 72 square inches on conventional heaters. This represents a reduction by over 1600 times from what has been standard practice in the catalytic heater industry. The average open area of 0.0432 square inches per square foot is the sum of the area of between 20 to 40 holes or apertures per square foot in the perforated plate 19 of the invention. Such a configuration is represented in FIG. 3 wherein there is shown a total of 36 holes or apertures 21 (6 by 6 rows) in one square foot of plate area. It is important to note that the size of the holes or apertures 21 are shown in the drawings (FIGS. 1–3) on a much larger scale than might actually be employed in practice merely for the purposes of illustration.

The gas enters the sealed plenum chamber 18 through a pre-sized gas orifice 22. The purpose of the orifice is to limit the volume of gas entering the plenum chamber 18 for a given pressure of gas from a suitable supply (not shown). The pressure drop across orifice 22 is equal to the pressure prior to the orifice minus the pressure in plenum chamber which is typically less than about 0.5 of a Water Column inch. In other words, by placing a sensitive pressure measuring device over any of the 20–40 apertures 21 in the perforated plate 19, a pressure of around 0.5 Water Column inches will register on the pressure gage. The pressure will be higher as the flow of gas is increased into plenum chamber 18 and will decrease when the flow of gas is decreased into plenum chamber. At any flow rate, the pressure remains the same at any of the 20–40 apertures per square foot, thereby ensuring an equal flow of gas through each of the apertures per square foot across the entire surface of plate 19 regardless of its total or overall surface area.

As the gas flows through the holes or apertures 21, it has a velocity perpendicular to the perforated plate 19. The velocity is greater at higher gas inputs into the catalytic heater and lower with less gas entering the heater. In order to ensure that the velocities remain the same at each of the apertures, it is essential to keep the apertures open and free from contact with other materials within the heater, particularly the fibers within the insulating layers 23, 24. Additionally, once the gas has cleanly exited each aperture, the gas velocity is reduced and redirected partially parallel to plate 19. To assure that these conditions are met, a woven or non-woven baffle member 25 is provided according to the invention. The baffle separates the insulation material from the plate 19 and prevents the apertures from becoming blocked by the insulation.

Table I below shows typical ranges of percent open area, hole diameters and pressure drops across the perforated plate in a catalytic heater according to the invention. The table shows data from 7 cubic feet/square foot gas flow into the heater.

TABLE I

| Pres. drop in W.C.* | Total hole area per square foot of heater | % open area | Number of holes per sq. ft. Diameter of holes 40 | 35 | 30 | 25 | 20 | 15 | 10 |
|---|---|---|---|---|---|---|---|---|---|
| .0025 | 0.085 | 0.059 | 0.0520 | 0.0556 | 0.0601 | 0.0658 | 0.0736 | 0.0850 | 0.1041 |
| 0.005 | 0.060 | 0.042 | 0.0438 | 0.0468 | 0.0505 | 0.0553 | 0.0619 | 0.0715 | 0.0875 |
| 0.0075 | 0.049 | 0.034 | 0.0395 | 0.0423 | 0.0457 | 0.0500 | 0.0559 | 0.0646 | 0.0791 |
| 0.01 | 0.043 | 0.030 | 0.0368 | 0.0393 | 0.0425 | 0.0465 | 0.0520 | 0.0601 | 0.0736 |
| 0.02 | 0.030 | 0.021 | 0.0309 | 0.0331 | 0.0357 | 0.0391 | 0.0438 | 0.0505 | 0.0619 |
| 0.03 | 0.025 | 0.017 | 0.0280 | 0.0299 | 0.0323 | 0.0354 | 0.0395 | 0.0457 | 0.0559 |
| 0.04 | 0.021 | 0.015 | 0.0260 | 0.0278 | 0.0300 | 0.0329 | 0.0368 | 0.0425 | 0.0520 |
| 0.05 | 0.019 | 0.013 | 0.0246 | 0.0263 | 0.0284 | 0.0311 | 0.0348 | 0.0402 | 0.0492 |
| 0.06 | 0.017 | 0.012 | 0.0235 | 0.0251 | 0.0271 | 0.0297 | 0.0332 | 0.0384 | 0.0470 |
| 0.07 | 0.016 | 0.011 | 0.0226 | 0.0242 | 0.0261 | 0.0286 | 0.0320 | 0.0369 | 0.0452 |
| 0.08 | 0.015 | 0.010 | 0.0219 | 0.0234 | 0.0253 | 0.0277 | 0.0309 | 0.0357 | 0.0438 |
| 0.09 | 0.014 | 0.010 | 0.0212 | 0.0227 | 0.0245 | 0.0269 | 0.0300 | 0.0347 | 0.0425 |
| 0.1 | 0.013 | 0.009 | 0.0207 | 0.0221 | 0.0239 | 0.0262 | 0.0293 | 0.0338 | 0.0414 |

*Water Column - Pressure drop assumes flow rate of natural gas at 7,000 btu/hour/sq. ft.

It has not been possible with the prior art catalytic heaters to evenly disperse low fire or low flow of gas at 2 cubic feet/hour over 1 square foot of heater/catalyst surface. This can be achieved, however, with the catalytic heater of the invention which disperses the fuel gas into a horizontal plane at the plenum chamber, as opposed to prior art heaters that use tubular arrangements. These tubular arrangements have holes through which the gas exits that are typically on 4–6 inch centers and point down away from the catalyst. The gas hits the back of the heater and reverses up towards the catalyst. In the catalytic heater of the invention using a plenum chamber, the gas exits the perforated plate directly to a baffle and then to the catalyst. The tubular arrangement of the prior art employs 1–4 holes per square foot on average. The holes are about an ⅛ inch (0.125 inch) in diameter. As seen in Table I, the catalytic heater of the invention can have up to 40 holes per square foot of heater area.

Natural gas which constitutes the majority of the fuel used with catalytic heaters, has a specific gravity of 0.65. As such, it is very light and difficult to disperse evenly into the catalyst. The plenum depth and hole diameters in the present catalytic heaters are designed to create just the right velocity of the gas as it exits the plenum chamber. Too much velocity and the gas "squirts" through the catalyst not allowing enough resonance time for the gas to be chemically oxidized by the platinum in the catalyst bed.

A sealed plenum, by definition, exerts equal pressure in all directions within the plenum. Therefore, if the holes in perforated plate are all of equal diameter, then the same flow or velocity of gas will take place at every hole. This concept has been demonstrated by test wherein the gas is lighted as it exits the plate. All the flames were the same height. The height increases from a low at 2 cubic feet/hour/sq. ft. to a high at 8 cubic feet/hour/ sq. ft..

Catalytic heaters of the invention consistently demonstrate improved methane slip rates as compared to catalytic heaters of the prior art. Prior catalytic heaters have shown methane slip rates up to as high as 25 percent (%) at typical operating levels of about 15 percent (%). With the improved catalytic heater of the invention, the catalyst receives the gas in an even, consistent flow across the entire surface of the heater. As a result, there is a consistent chemical reaction that takes place at the catalyst layer. This in turn produces an even temperature across the entire heater surface. In the prior catalytic heaters, gas is unevenly distributed causing varying quantities of the gas to react with the catalyst. As a result, non-uniform temperature distributions and "cold spots" occur on the working element. It is in the areas where larger quantities of fuel gas contact the catalyst and cannot be chemically reacted, that is, at high gas flow rates, that methane slippage most frequently occurs. Laboratory testing of catalytic heaters made according to the invention have shown methane slippage to be less than about 5 percent (%) of the input levels. The gas dispersion system of the invention thus allows the catalytic reaction to be more efficient in converting the BTUs of the gas into heating energy. Because of this increased efficiency, greater heat outputs are possible with the catalytic heaters of the invention. In addition, methane slippage may even be even further reduced as the output is increased. Thus, whereas the slip rate is about 5 percent (%) at 6000 BTUs output, the slippage may be reduced to as little as about 3 percent (%) at 8000 BTUs.

What is claimed is:

1. In a gas catalytic heater including a body, a catalytically active porous layer disposed within said body, at least one heat insulating layer containing fibers disposed below said catalytically active porous layer and a sealed plenum chamber having a wall portion facing toward said catalytically active layer wherein said wall portion contains a plurality of tiny, substantially equally spaced apart apertures having a diameter of between about 0.02 and 0.1 inch for the passage of a combustible gas therethrough, the improvement in combination therewith of a porous baffle member disposed between said insulating layer and said wall portion for distributing portions of said gas in a direction substantially parallel to said wall portion after passing through said aperatures, said baffle member also separating said wall portion from said insulating layer and prohibiting said fibers from entering and blocking said apertures to the passage of gas therethrough.

2. A gas catalytic heater according to claim 1, wherein said porous baffle member is a woven metal mesh.

3. A gas catalytic heater according to claim 1, wherein said wall portion of said sealed plenum chamber comprises a solid perforated member having an open area of between about 0.009 and about 0.06 percent of the entire surface provided by said apertures area of said perforated member.

4. A gas catalytic heater according to claim 3, wherein said solid perforated member comprises a metal plate having between about 20 and 40 apertures per square foot of said plate, the sum of the open area provided by said apertures being between about 0.013 and 0.085 square inches per square foot.

5. A gas catalytic heater according to claim 4, wherein the volume of said plenum chamber is sufficient to permit between about 200 volume changes per hour at a gas flow rate of about 3 cubic feet per square foot per hour and 800 volume changes at a gas flow rate of about 6 cubic feet per square foot per hour.

6. A gas catalytic heater comprising, in combination:

a body;

a catalytically active layer disposed within said body;

at least one porous heat insulating layer composed of fibers disposed below said catalytically active layer;

a sealed plenum chamber having a wall portion facing toward said catalytically active layer, said wall portion containing between about 20 and 40 substantially equally spaced apart apertures per square foot of said wall portion, said apertures providing a relatively small total open area of between about 0.013 and 0.085 square inches per square foot of said wall portion;

gas inlet means for introducing said combustible gas into said plenum chamber;

means for limiting the flow rate of said gas entering said plenum chamber such that said gas passes through said relatively small open area provided by said apertures at a low enough velocity to permit substantially complete consumption of said gas by said catalytically active layer; and a porous baffle member disposed adjacent to and in contact with said wall portion for distributing portion of said gas passing through said aperatures in a direction substantially parallel to said wall portion, said baffle member also separating said wall portion from said insulating layer and prohibiting said fibers from entering and blocking said apertures to the passage of gas therethrough.

7. A gas catalytic heater according to claim 6, wherein the volume of said plenum chamber is sufficient to permit between about 200 volume changes per hour at a gas flow rate of about 3 cubic feet per square foot per hour and 800 volume changes at a gas flow rate of about 6 cubic feet per square foot per hour.

8. A gas catalytic heater according to claim 6, wherein said body comprises a shallow metal pan having a bottom wall and upstanding side walls and wherein said wall portion comprises a perforated metal plate including a peripheral rim portion which fits snugly against said side walls.

9. A gas catalytic heater according to claim 8, wherein said plenum chamber is sealed by a bead interposed between the outer edges of said perforated metal plate and said bottom wall.

10. A gas catalytic heater according to claim 9, wherein said bead is made from an adhesive material.

11. A gas catalytic heater according to claim 9, wherein said bead is made from a resilient material.

12. A gas catalytic heater according to claim 11, wherein said resilient bead is held under compression by means of a bolt and nut mounted between said plate and said bottom wall.

* * * * *